United States Patent [19]

Ballik et al.

[11] Patent Number: 4,511,082

[45] Date of Patent: Apr. 16, 1985

[54] FUEL-INJECTION SYSTEMS AND ASSOCIATED METHODS

[75] Inventors: Rainer Ballik, Moers; Heinrich Hütten, Kaarst, both of Fed. Rep. of Germany

[73] Assignee: Pierburg GmbH & Co., KG, Neuss, Fed. Rep. of Germany

[21] Appl. No.: 514,962

[22] Filed: Jul. 18, 1983

[30] Foreign Application Priority Data

Jul. 29, 1982 [DE] Fed. Rep. of Germany ..... 3228323

[51] Int. Cl.[3] ..... B05B 15/06

[52] U.S. Cl. ..... 239/8; 239/453; 239/585

[58] Field of Search ..... 239/533.12, 451, 452, 239/453, 456, 457, 458, 459, 585, 8; 251/118, 127

[56] References Cited

U.S. PATENT DOCUMENTS 4,421,280 12/1983 Lewis ..... 239/585

*Primary Examiner*—Jeffrey V. Nase
*Assistant Examiner*—David S. Ebner
*Attorney, Agent, or Firm*—Posnack, Roberts, Cohen & Spiecens

[57] ABSTRACT

A fuel-injection valve comprises an electromagnetically actuated armature attached to the needle-like stem of a valve head. In order to promote control of fuel flow under varying conditions the valve opens by moving the valve head downstream from its valve seat and the stroke of the valve head is limited by a mechanical stop situated downstream of the valve seat.

9 Claims, 2 Drawing Figures

FUEL-INJECTION SYSTEMS AND ASSOCIATED METHODS

FIELD OF THE INVENTION

The invention relates to fuel-injection systems and, in particular, to a valve for controlling the flow of liquid fuel injected into the induction pipe of an internal combustion engine. The valve includes an electromagnetically actuated armature attached to the stem of a valve head which cooperates with a valve seat.

The invention also relates to a method of operating such valve.

PRIOR ART

U.S. Pat. No. 2,612,408 discloses an outwards-opening fuel-injection valve in which the valve impacts on its seat each time the valve closes, to interrupt the flow of liquid fuel. The pressure in the fuel flow automatically pulses the valve and its biassing spring so that they oscillate. Such fuel-injection valve is not equipped with an electromagnetic actuator and consequently does not control the rate of flow of fuel.

Fuel-injection valves are also known in the art which open inwards, i.e. in the direction upstream of flow. These valve do not favor good atomization of the liquid fuel.

For good atomization, and controlling the rate of flow of the fuel an electromagnetically actuated fuel-injection valve must open and close at high interruption rates. The moving masses should therefore be small and consequently the moving armature of the electromagnetic system should be connected to the valve head by means of a needle or connecting rod of small diameter. As the needle is wetted by the flowing fuel, this influences its temperature, producing temperature-dependent changes in the length of the needle and consequently changing the stroke of the valve head if the armature moves against a stop and changing the quantity of liquid fuel metered out by the fuel-injection valve during each opening period.

SUMMARY OF THE INVENTION

An object of the present invention is to provide a fuel-injection valve in which the stroke of the valve head is not influenced by temperature changes.

This object is satisfied, according to the invention, in that the valve is opened by lifting the valve head off its seat in the downstream direction, the stroke of the valve head being limited by a mechanical stop situated downstream of the valve seat. This ensures that when the length of the needle changes, this merely changes the position of rest of the armature within the electromagnetic system, the stroke of the valve head being determined by the distance between the seated valve head and the mechanical stop.

To improve atomization of the liquid fuel, the mechanical stop can be constructed to act as a spray-forming plate. In addition the valve head can be given a mushroom-like shape.

The invention will now be described in greater detail with reference to the embodiment shown in the appended drawing.

DETAILED DESCRIPTION

Figure 1:
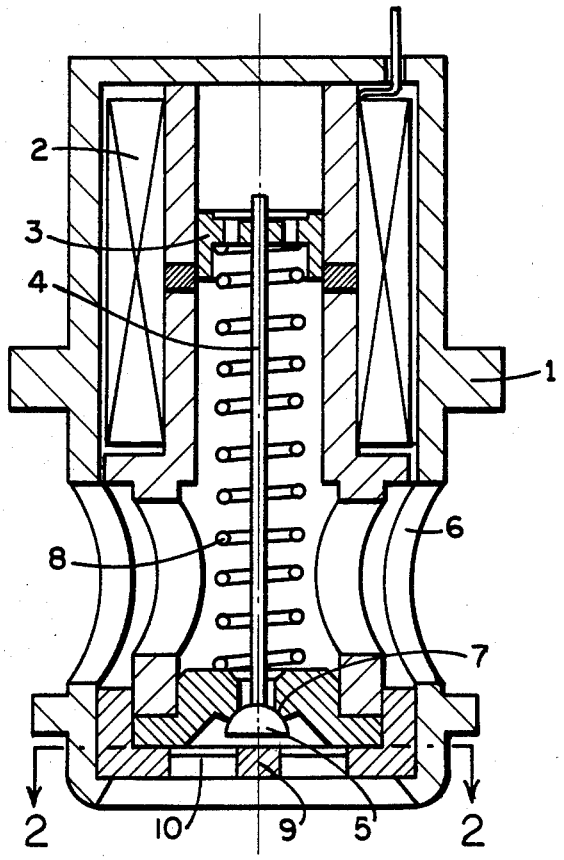
FIG. 1 is a longitudinal sectional view of an embodiment of a fuel injection valve according to the invention.
Figure 2:
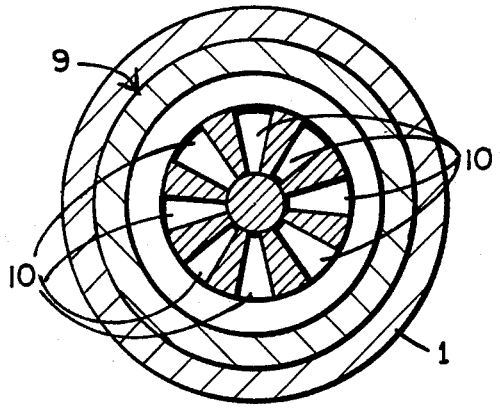
FIG. 2 is a sectional view taken on line 2—2 in FIG. 1.

In the drawing is seen a fuel injection valve 1 having a solenoid coil 2 containing an armature 3 to which is connected a needle or rod 4 which serves as a stem for a valve head 5. Liquid fuel arriving through an inlet 6 wets the needle 4 and the armature 3. A valve seat 7 is situated at the outlet of the valve. The valve head 5, attached to the needle 4, is situated downstream of the outlet and cooperates with the valve seat to close off the flow of fuel when the head 5 is seated on valve seat 7. The stroke of the valve head 5, when it is lifted from its seat against the action of its biassing spring 8, is limited by a mechanical stop 9 situated downstream of the valve seat 7. Atomization of the liquid fuel is assisted by the mushroom shape of the valve head 5, whose diameter increases in the downstream direction, as well as by perforations 10 in the mechanical stop 9, which is constructed to act as a spray-forming plate.

In operation, in the closed position of the valve, the rounded surface of the mushroom shaped valve head 5 abuts against the valve seat 7 under the action of the biassing spring 8. When the solenoid is energized, the armature is displaced to move the valve stem, against the action of spring 8, and cause the valve head to move to its open position which is limited by the abutment of the flat surface of the valve head against the mechanical stop 9.

Numerous modifications and variations will become evident to those skilled in the art of the embodiment which has been shown herein by way of example. Such modifications and variations will be considered to fall within the scope and spirit of the invention if defined by the attached claims.

What is claimed is:

1. A fuel-injection valve for injecting liquid fuel into the induction pipe of an internal combustion engine, comprising an electromagnetically actuated armature, a stem attached to said armature for movement therewith, a valve head on said stem, a valve seat on which said valve head is seated in closed position in which fuel flow is blocked, the arrangement of said valve head and seat being such that the valve is opened by lifting the valve head off its seat in the direction of flow of the fuel, and a mechanical stop situated downstream of the valve seat for engaging the valve head in its open position to limit the stroke of the valve head.

2. A valve as claimed in claim 1 wherein said mechanical stop is constructed to act as a spray-forming plate.

3. A valve as claimed in claim 2 wherein said spray-forming plate is provided with perforations.

4. A valve as claimed in claim 2 wherein said valve head has a mushroom-like shape promoting, in conjunction with said mechanical stop, atomization of fuel flowing through the valve.

5. A valve as claimed in claim 4 wherein said mushroom-like shaped valve head has a rounded surface which abuts against said seat in the closed position of the valve and a flat surface which abuts against said mechanical stop in said open position of the valve.

6. A valve as claimed in claim 5 comprising a biassing spring acting on said armature to urge the valve head against said seat.

7. A method of operating a fuel-injection valve for injecting liquid fuel into the induction pipe of an internal combustion engine, the valve having an electromagnetically actuated armature, a stem attached to said armature for movement therewith, a valve head on said stem, and a valve seat on which said valve head is seated in closed position in which fuel flow is blocked, said method comprising opening the valve by lifting the valve head off its seat in the direction of flow of the fuel, and halting the opening movement of the valve head at a fixed location defining the open position of the valve and limiting the stroke of the valve head by a mechanical stop, said method further comprising forming said stop as a spray-forming plate to effect atomization of fuel flowing through the open valve.

8. A method as claimed in claim 7 comprising forming said valve head with a mushroom-like shape to promote, in conjunction with said mechanical stop, the atomization of fuel flowing through the open valve.

9. A method as claimed in claim 8 comprising biassing said armature to urge the valve head against said seat.

* * * * *